US010544902B2

(12) United States Patent
Nevison

(10) Patent No.: US 10,544,902 B2
(45) Date of Patent: Jan. 28, 2020

(54) LIQUEFIED NATURAL GAS VAPORIZER FOR DOWNHOLE OIL OR GAS APPLICATIONS

(71) Applicant: Halliburton Energy Services, Inc., Houston, TX (US)

(72) Inventor: Grant W. Nevison, Bragg Creek (CA)

(73) Assignee: Halliburton Energy Services, Inc., Houston, TX (US)

( * ) Notice: Subject to any disclaimer, the term of this patent is extended or adjusted under 35 U.S.C. 154(b) by 174 days.

(21) Appl. No.: 15/522,280

(22) PCT Filed: Nov. 27, 2015

(86) PCT No.: PCT/CA2015/051240

§ 371 (c)(1),
(2) Date: Apr. 26, 2017

(87) PCT Pub. No.: WO2016/086295

PCT Pub. Date: Jun. 9, 2016

(65) Prior Publication Data

US 2017/0356597 A1 Dec. 14, 2017

Related U.S. Application Data

(60) Provisional application No. 62/086,501, filed on Dec. 2, 2014.

(51) Int. Cl.
*F17C 7/04* (2006.01)
*F17C 9/02* (2006.01)
(Continued)

(52) U.S. Cl.
CPC ..... *F17C 9/02* (2013.01); *E21B 43/26* (2013.01); *F22B 1/1884* (2013.01); *F23N 5/242* (2013.01);
(Continued)

(58) Field of Classification Search
CPC ..... F17C 7/04; F17C 2201/054; F17C 2221/033; F17C 2223/033;
(Continued)

(56) References Cited

U.S. PATENT DOCUMENTS 3,770,048 A * 11/1973 Linhardt ..... F17C 9/02 165/299
7,168,395 B2 * 1/2007 Engdahl ..... F22B 1/1853 122/31.1
(Continued)

FOREIGN PATENT DOCUMENTS

WO 2011001114 1/2011
WO 2012050580 4/2012
WO 2012/097426 A1 7/2012

OTHER PUBLICATIONS

International Search Report and Written Opinion of PCT Application No. PCT/CA2015/051240 dated Feb. 16, 2016: 1-9.

*Primary Examiner* — Gregory A Wilson
(74) *Attorney, Agent, or Firm* — Chamberlain Hrdlicka

(57) ABSTRACT

A vaporizer apparatus for vaporizing liquefied natural gas (LNG) into vapor-phase natural gas for injection into an oil or gas well, comprises a blower assembly, a burner section, a heat exchanger section, and at least one flammable gas concentration sensor. The blower assembly comprises a primary blower configured to move air along an air flow path through the vaporizer apparatus and a flame arrestor configured to allow passage of the air into the vaporizer apparatus and impede passage of a flame out of the vaporizer apparatus. The burner section comprises an enclosure having an upstream end coupled to the blower assembly and a downstream end, and a burner inside the enclosure and in the air flow path for heating the air. The heat exchanger section comprises an enclosure having an upstream end coupled to the downstream end of the burner section enclosure and a
(Continued)

downstream end, and at least one LNG heat exchange tube inside the enclosure and in the air flow path, and thermally communicable with the air heated by the burner. The at least one flammable gas concentration sensor is in the air flow path upstream of the burner and is configured to detect whether a concentration of a flammable gas in the air is above a flammable gas concentration set point.

21 Claims, 8 Drawing Sheets

(51) Int. Cl.
*E21B 43/26* (2006.01)
*F22B 1/18* (2006.01)
*F23N 5/24* (2006.01)

(52) U.S. Cl.
CPC .. *F17C 2221/033* (2013.01); *F17C 2223/013* (2013.01); *F17C 2225/0123* (2013.01); *F17C 2270/0554* (2013.01)

(58) Field of Classification Search
CPC ..... F17C 2225/0161; F17C 2227/0142; F17C 2227/2227; F17C 2227/0302; F17C 2227/039; F17C 2227/0393; F17C 2265/03; F17C 2265/05
See application file for complete search history.

(56) References Cited

U.S. PATENT DOCUMENTS

| | | | | |
|---|---|---|---|---|
| 8,950,196 | B2 * | 2/2015 | Mak | F17C 5/06 60/645 |
| 8,991,499 | B2 * | 3/2015 | Nevison | E21B 43/26 166/308.2 |
| 8,993,565 | B2 | 3/2015 | Carry et al. | |
| 10,107,455 | B2 * | 10/2018 | Shaaban | F17C 7/04 |
| 2002/0104644 | A1 | 8/2002 | Nishimura et al. | |
| 2005/0235654 | A1 | 10/2005 | Kaupert et al. | |
| 2008/0250795 | A1 * | 10/2008 | Katdare | F17C 9/02 62/50.2 |
| 2011/0289940 | A1 * | 12/2011 | Zhao | F17C 9/04 62/50.2 |

* cited by examiner

LIQUEFIED NATURAL GAS VAPORIZER FOR DOWNHOLE OIL OR GAS APPLICATIONS

FIELD

This invention relates generally to a liquefied natural gas (LNG) vaporizer for downhole oil or gas applications including well completion and well maintenance operations.

BACKGROUND

Downhole oil and gas operations that involve gas injection include hydraulic fracturing, well servicing, and industrial maintenance.

Hydraulic fracturing is a common technique used to improve production from existing wells, low rate wells, new wells and wells that are no longer producing. Fracturing fluids and fracture propping materials are mixed in specialized equipment then pumped through a wellbore and into a subterranean formation containing the hydrocarbon materials to be produced. Injection of fracturing fluids that carry the propping materials is completed at high pressures sufficient to fracture the subterranean formation. The fracturing fluid carries the propping materials into the fractures. Upon completion of the fluid and proppant injection, the pressure is reduced and the proppant holds the fractures open. The well is then flowed to remove the fracturing fluid from the fractures and formation. Upon removal of sufficient fracturing fluid, production from the well is initiated.

Well servicing (also known as well intervention or well work) is an operation carried out on an oil or gas well during or at the end of its productive life, which alters the state of the well and/or well geometry, provides well diagnostics, or manages the production of the well.

It is also known to inject gases for oil and gas maintenance and testing operations within the scope of producing, refining and transporting hydrocarbons sourced from subterranean formations. Such maintenance and testing operations include pressuring, pressure testing, purging, displacement, carrying, inerting, catalyst regeneration, injectivity testing, capacity testing or drying within wells, facilities, refineries and pipelines.

Natural gas can be used as an injection gas in hydraulic fracturing operations. For example, Applicant's own PCT publication no. WO 2012/097426 discloses a method for hydraulically fracturing a formation in a reservoir using a fracturing fluid mixture comprising natural gas and a base fluid. The base fluid can comprise a conventional hydrocarbon well servicing fluid comprised of alkane and aromatic based hydrocarbon liquids with or without a gelling agent and proppant. This base fluid is combined with a gaseous phase natural gas stream to form the fracturing fluid mixture. In one embodiment, the natural gas can be provided from an LNG source, wherein the LNG is pressurized by a pump to a suitable fracturing pressure, and converted into vapor phase natural gas by a heater. More particularly, a heat source is disclosed which heats air that is driven across heat exchanger coils by a blower. The heat source can be generated without flame and may be waste heat or generated heat from an internal combustion engine, a catalytic burner or an electric element. Alternatively, the heat can be generated using a flame based heat source local to the heater or remote as dictated by safety requirements.

When a local flame is used to generate the heat, there is a risk of an unintended combustion event that may be harmful, if natural gas unexpectedly comes in contact with the local flame. Therefore, it is desirable to provide a means for heating LNG with a local flame that can address such a challenge.

SUMMARY

According to one aspect of the invention, there is provided a vaporizer apparatus for vaporizing liquefied natural gas (LNG) into vapor-phase natural gas for injection into an oil or gas well. The apparatus comprises a blower assembly, a burner section, a heat exchanger section, and at least one flammable gas concentration sensor. The blower assembly comprises a primary blower configured to move air along a supply air flow path through the vaporizer apparatus and optionally a flame arrestor configured to allow passage of the air into the vaporizer apparatus and impede passage of a flame out of the vaporizer apparatus. The burner section comprises an enclosure having an upstream end coupled to the blower assembly and a downstream end, and at least one burner inside the enclosure and in the supply air flow path for heating the air. The heat exchanger section comprises an enclosure having an upstream end coupled to the downstream end of the burner section enclosure and a downstream end, and at least one LNG heat exchange tube inside the enclosure and in the supply air flow path, and thermally communicable with the air heated by the burner. The at least one flammable gas concentration sensor is in the air flow path upstream of the burner and is configured to detect whether a concentration of a flammable gas in the air is above a flammable gas concentration set point.

The at least one flammable gas concentration sensor can comprise a gas concentration sensor mounted outside the vaporizer apparatus and in the supply air flow path upstream of the primary blower. At least one temperature sensor can be located inside the vaporizer apparatus downstream of the burner, and is configured to detect whether the temperature inside the vaporizer apparatus is above a temperature set point.

The vaporizer apparatus can further comprise an exhaust duct having an upstream end coupled to the downstream end of the heat exchanger enclosure, and an outlet for discharging the air and combustion products from the vaporizer apparatus; the at least one flammable gas concentration sensor comprises an exhaust gas concentration sensor in the exhaust duct. The at least one temperature sensor can include an exhaust temperature sensor in the exhaust duct, as well as a heat exchanger temperature sensor inside the heat exchanger enclosure that is configured to measure the temperature of the air blown by the primary blower and heated by the burner. Optionally, an ultraviolet or infrared flame detector can be located in the exhaust duct.

The blower assembly, burner section enclosure, and heat exchanger section enclosure can be sealed or gasketed to produce at least a flame-tight air flow pathway through the inside of the vaporizer apparatus.

The vaporizer apparatus can further comprise a cooling air assembly comprising a secondary cooling air source in air flow communication with the air moved by the primary blower and heated by the burner. The secondary cooling air source can comprise a cooling air blower controllable independently from the primary blower.

The vaporizer apparatus can further comprise a cooling air assembly comprising at least one cooling air duct having an inlet in air flow communication with the air moved by the primary blower but not heated by the burner, and an outlet in air flow communication with the air moved by the primary blower and heated by the burner, and a control valve in air flow communication with the at least one cooling air duct and operable to control the flow rate of air flowing therethrough.

According to another aspect of the invention, there is provided a method for operating a direct-fired vaporizer apparatus to vaporize liquefied natural gas (LNG) into vapor-phase natural gas for injection into an oil or gas well, comprising: operating a primary blower to move the air into the vaporizer apparatus, measuring a flammable gas concentration in air for use in the vaporizer apparatus; and when the measured flammable gas concentration is below a flammable gas concentration set point, operating the burner to provide the air with enough heat energy to vaporize LNG flowing through at least one heat exchange tube inside the vaporizer apparatus. The method can further comprise measuring a temperature of the air moved into the vaporizer apparatus and heated by a burner in the vaporizer apparatus, and when the measured temperature of the air is below a temperature set point, operating the burner to provide the air with enough heat energy to vaporize LNG flowing through at least one heat exchange tube inside the vaporizer apparatus.

When the measured flammable gas concentration is at or above the flammable gas concentration set point, the method can further comprise stopping operation of the primary blower and burner. When the measured temperature of the heated air is at or above the temperature set point, the method can comprise adjusting the primary blower operation to increase the flow rate of the air through the vaporizer apparatus. When the measured temperature of the air is at or above the temperature set point, the method can also comprise moving cooling air into the vaporizer apparatus to cool the air moved by the primary blower and heated by the burner. Alternatively, when the measured temperature of the heated air is at or above the temperature set point, the method can comprise adjusting the air temperature by reducing the burner fuel or the number of burners fired.

The method can further comprise measuring a flammable gas concentration in exhaust air heated by the burner, and monitoring for a flame in the vaporizer apparatus downstream of the burner; when the measured flammable gas concentration in the exhaust air is at or above the flammable gas concentration set point or when a flame is detected, operation of the primary blower and burner is stopped.

Stopping operation of the primary blower and burner can comprise purging the vaporizer apparatus by operating the primary blower to move air through the vaporizer apparatus.

Stopping operation of the primary blower and burner can further comprise measuring the flammable gas concentration and air temperature inside the vaporizer and releasing an extinguishing gas into the vaporizer apparatus when at least one of the measured flammable gas concentration and air temperature is at or above the respective flammable gas concentration set point and temperature set point.

DETAILED DESCRIPTION

Directional terms such as "top," "bottom," "upstream," and "downstream" are used in the following description for the purpose of providing relative reference only, and are not intended to suggest any limitations on how any article is to be positioned during use, or to be mounted in an assembly or relative to an environment. In particular, the terms "upstream" and "downstream" are used to provide relative reference to a flow path of a fluid, such as air.

Embodiments of the invention described herein relate generally to a direct-fired vaporizer apparatus for converting liquefied natural gas (LNG) into vapor phase natural gas, and a method for operating such a vaporizer apparatus especially in respect to start up, shut down, and normal operation thereof.

As used in this disclosure, natural gas means methane ($CH_4$) alone or blends of methane with other gases such as other gaseous hydrocarbons. Natural gas is often a variable mixture of about 85% to 99% methane ($CH_4$) and 5% to 15% ethane ($C_2H_6$), with further decreasing components of propane ($C_3H_8$), butane ($C_4H_{10}$), pentane ($C_5H_{12}$) with traces of longer chain hydrocarbons. Natural gas, as used herein, may also contain inert gases such as carbon dioxide and nitrogen in varying degrees though volumes above approximately 30% would degrade the benefits received from the intended applications of the embodiments. CNG refers to compressed natural gas. LNG refers to liquefied natural gas.

Figure 1A:
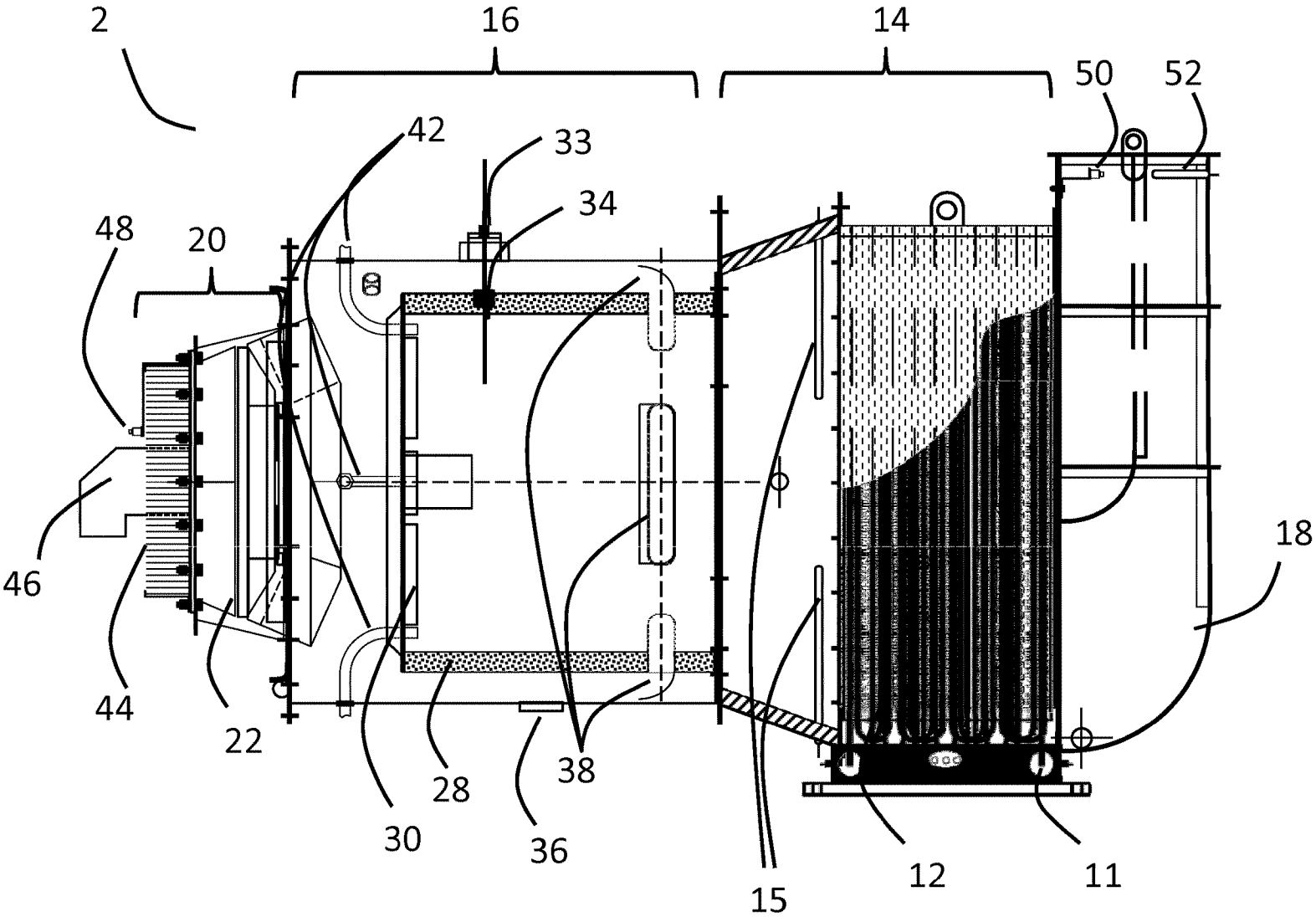
FIGS. 1(*a*) and (*b*) are respective sectioned side and front end views of a LNG vaporizer according to one embodiment of the invention.
Figure 1B:
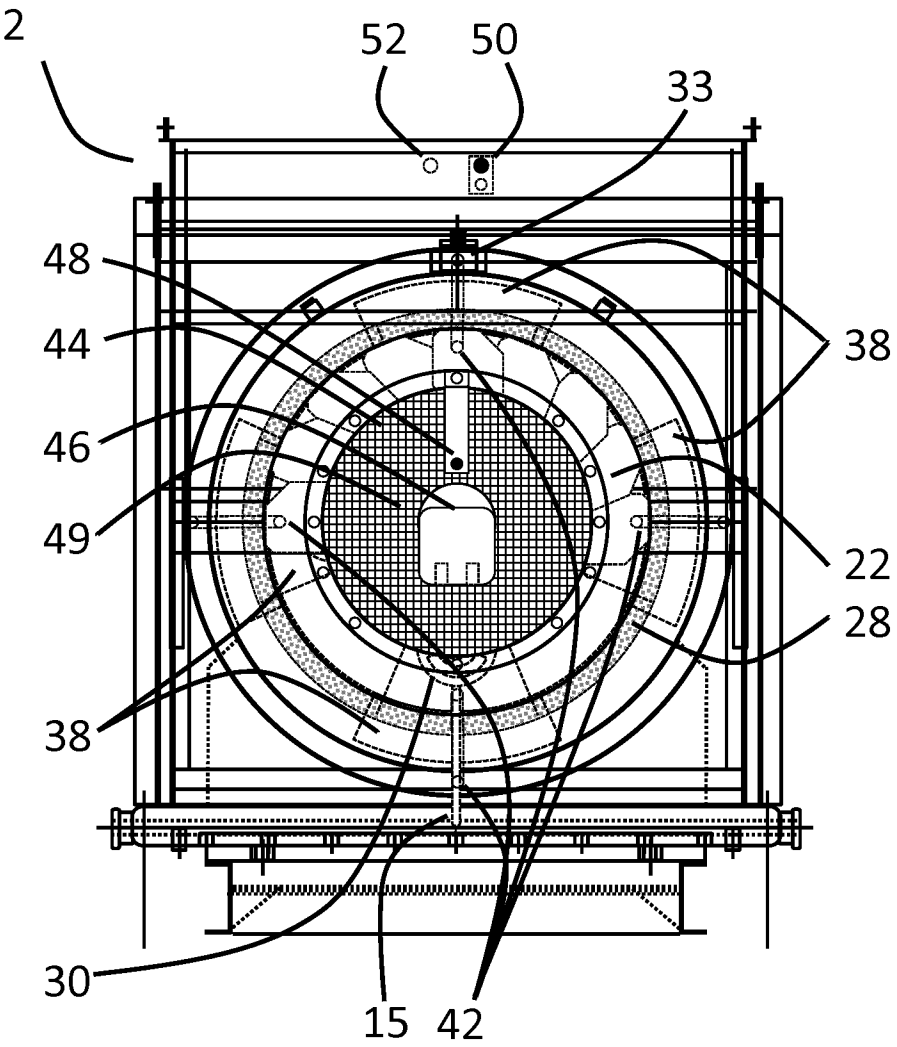
Figure 2:
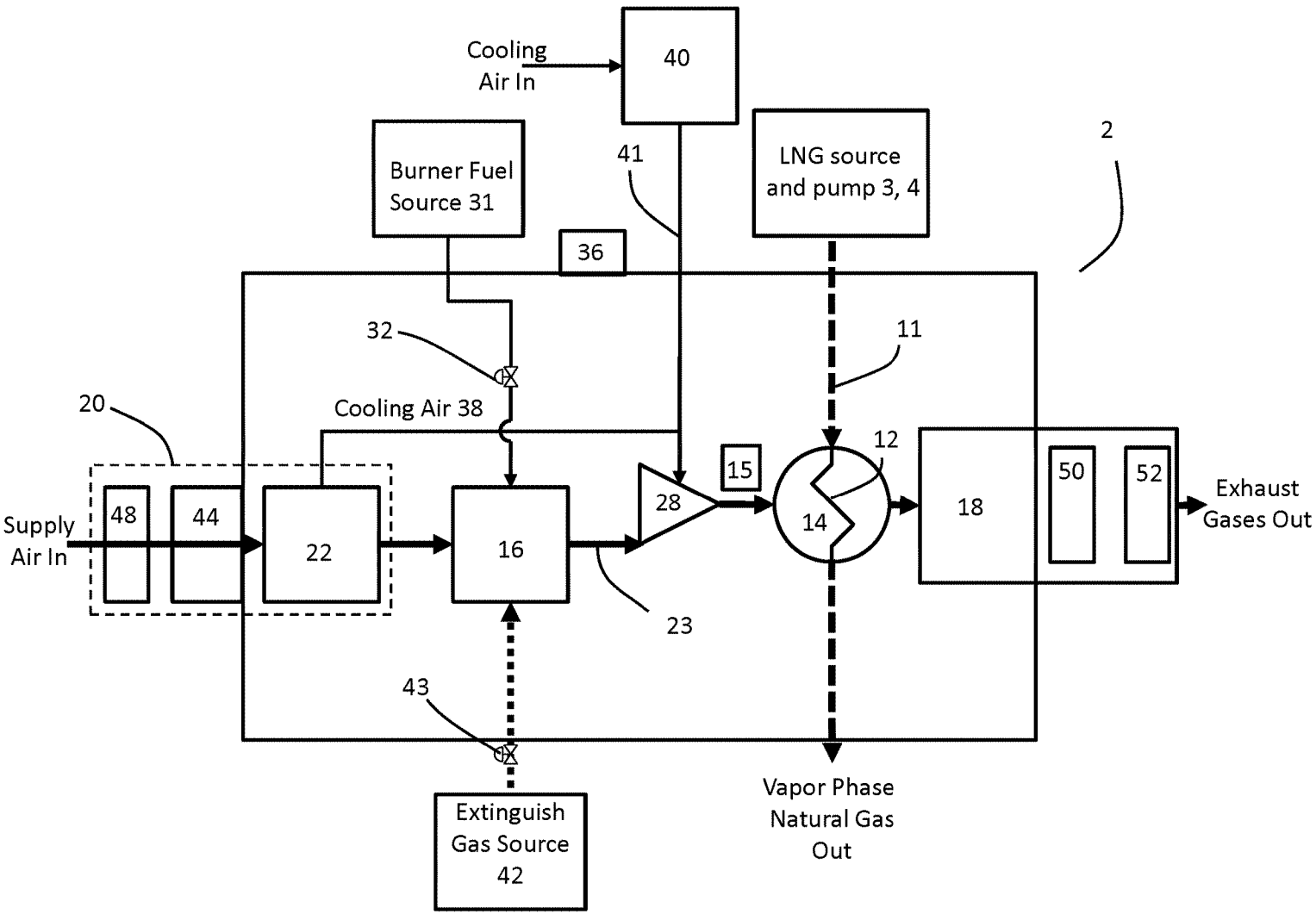
FIG. 2 is a schematic block diagram of components of the LNG vaporizer.

Referring to FIGS. 1 and 2, and according to one embodiment, an LNG vaporizer apparatus 2 is provided for use in downhole oil and gas operations that inject vapor phase natural gas into a well, including but not restricted to: hydraulic fracturing, well servicing, artificial lift, enhanced oil recovery gas injection and industrial maintenance. While embodiments in this description will relate primarily to an LNG vaporizer apparatus used in hydraulic fracturing operations, it is understood that the LNG vaporizer apparatus can be readily adapted for use in other downhole oil and gas operations according to other embodiments of the invention.

Figure 7:
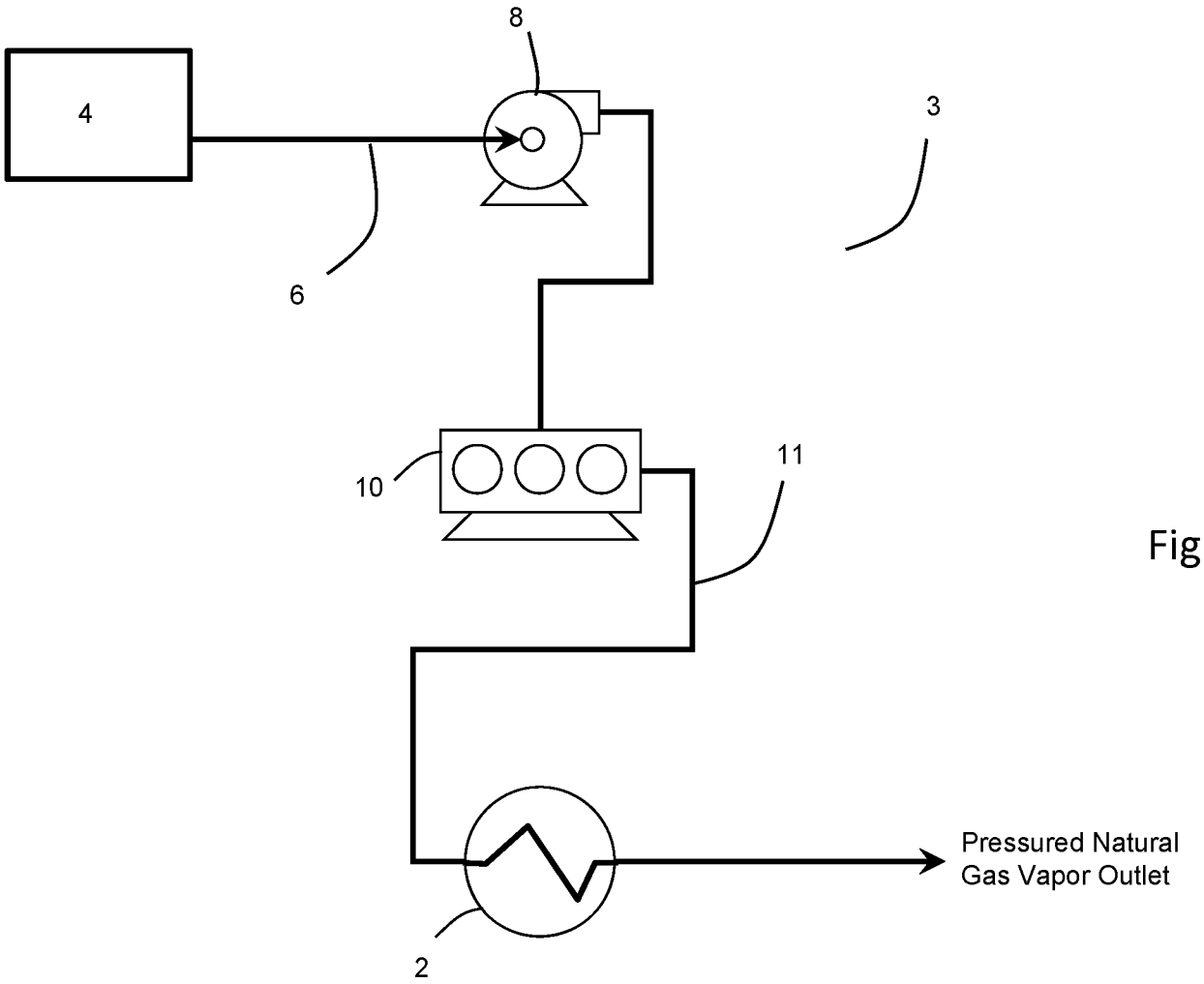
FIG. 7 is a schematic illustration of a natural gas fracturing pump assembly comprising the LNG vaporizer.

For a hydraulic fracturing application and referring to FIG. 7, the vaporizer apparatus 2 can be a component of a high pressure natural gas fracturing pump assembly 3 that also includes a pump component which is fluidly coupled to an LNG source 4, such as LNG storage tanks, and which is configured to pressurize the LNG to a suitable fracturing pressure. LNG is fed to the pump component from a supply conduit 6 coupled to the LNG storage tanks 4. The pump component comprises an optional pressure boost pump 8, a high pressure LNG pump 10 and a conduit interconnecting the pressure boost pump 8 and the LNG pump 10. A single or multiple cryogenic centrifugal pump may be applied as the boost pump 8 as needed to meet the feed pressure and rate requirement to support the high pressure LNG pump 10.

Pressurized LNG exiting the high pressure LNG pump 10 is directed to the vaporizer apparatus 2 via a heat exchanger conduit 11. Referring again to FIGS. 1 and 2, the heat exchanger conduit 11 is fluidly coupled to a plurality of heat exchange tubes 12 (alternatively referred to as "bundles") inside the heat exchanger section 14. The heat exchanger section 14 comprises an enclosure that has a generally rectangular box shape with a tapered upstream end having an air flow inlet and a downstream end having an air flow outlet; alternatively, the enclosure can have shapes other than a rectangular box. A pair of temperature probes 15 ("heat exchanger temperature sensors") are mounted on the inside of the enclosure at the upstream end of the heat exchanger section 14 and serve to measure the temperature of air entering the heat exchanger section 14 which can be used to determine the temperature of the air at the heat exchange tubes 12. Although two probes are provided in this embodiment, a different number of temperature probes can be used for this purpose. Also, the temperature probes can be located elsewhere in the heat exchanger section, such as immediately upstream or downstream of the heat exchange tubes 12.

The vaporizer apparatus 2 also comprises a burner section 16 having a downstream end coupled to the air flow inlet of the heat exchanger section 14, exhaust ducting 18 coupled to the air flow outlet of the heat exchanger section 14, and a primary blower assembly 20 that is mounted to an upstream end of the burner section 16 and comprises a primary blower 22. The primary blower assembly 20, burner section 16, heat exchanger section 14 and exhaust ducting 18 together define an air flow pathway 23 inside the vaporizer apparatus 2 wherein ambient temperature air ("supply air") is sucked into the vaporizer apparatus 2 by the primary blower assembly 20 and is blown into the burner section 16, wherein some of the air is used to combust fuel supplied to the burner section 16, creating combustion products and heating the remaining air to an elevated temperature. The heated air then flows through the heat exchanger section 14 wherein heat energy in the air vaporizes the LNG flowing inside the heat exchange tubes 12. Exhaust gases comprising the heated air and combustion products then exit the vaporizer apparatus 2 via the exhaust ducting 18, and the vapor phase natural gas is injected into the well for hydraulic fracturing or other purposes. The vaporizer apparatus 2 is provided with seals and gaskets (not shown) at seams and connections between components to provide at least a "flame tight" air flow pathway inside the vaporizer apparatus 2 and preferably an air-tight air flow pathway. "Flame tight" in this context means that the vaporizer apparatus enclosure has no seams or openings larger than a single channel aperture of a typical flame arrestor.

The burner section 16 comprises an enclosure that is a generally cylindrically-shaped barrel with an upstream end having an air flow inlet configured to mount the primary blower assembly 20 thereto, and a downstream end having an air flow outlet that mates with the air flow inlet of the heat exchanger section 14 enclosure. The burner section 16 also comprises an inner barrel assembly 28 comprising a generally cylindrical side wall, an annular flange that mounts a downstream end of the side wall to the junction of the burner section 16 and heat exchanger section 14, and a burner assembly 30 comprising a mounting plate mounted to the upstream end of the side wall, a central air inlet in the centre of the mounting plate for flowing air from the blower assembly 20 into the inner barrel assembly 28 for combustion, a fuel nozzle for supplying fuel to the burner assembly 30 and an ignition module for generating a spark to ignite the fuel. Alternatively, other burner configurations known to those skilled in the art can be used, such as burners manufactured by Cryoquip, which do not have burner barrels per se, and instead flow air around each burner 'pot' to maintain a suitable pot temperature. The burner may use a number of different fuels known in the art for this purpose, including liquid or gaseous hydrocarbons such as natural gas, propane, ethane, butane, gasoline, kerosene, diesel fuel or fuel oil. The fuel can be supplied from a pressurized fuel source 31 that is controlled by a solenoid (not shown) provided for each burner; a master shut-off valve 32 can also be controlled to shut off fuel flow in the event of an emergency. The burner assembly 30 can be based on burner assemblies found in commercially available nitrogen vaporizers such as those provided by NOV Hydra Rig, L&S Cryogenics and CS&P Technologies. A fire burner photocell unit 33 is mounted on the burner section enclosure and is used to detect a flame in the inner barrel assembly 28 via a sight glass 34 in the side wall of the barrel assembly 28. A temperature sensor 36 ("enclosure temperature sensor") is also mounted to the burner section enclosure wall and serves to measure the enclosure wall temperature. Alternatively, one or more temperature sensors (not shown) can be mounted at other locations around or along the vaporizer enclosure for this purpose.

The burner section 16 further comprises a cooling air assembly 38 that serves to inject air into the inner barrel assembly 28 to modulate the temperature of the heated air flowing out of the inner barrel assembly 28. The cooling air assembly 38 comprises a series of openings extending around the side wall of the inner barrel assembly 28, at the downstream end thereof. Ducts extend from each opening and into an annular space between the walls of the burner section enclosure and the inner barrel assembly 28. Cool air blown into the burner section 16 that does not flow through the central air inlet of the inner barrel assembly 28 will flow into the annular space and through the ducts into the downstream end of the inner barrel assembly 28; this air serves as "cooling air" to cool the air heated by combustion inside the inner barrel assembly 28 ("heated air"). The size of the ducts and openings of the cooling air assembly 38 are selected so that the cooling air can quench the flame prior to impinging on the bundles and further lower the temperature of the heated air below the auto ignition temperature of natural gas, even when the primary blower 22 and the burner section are operating to generate enough heat energy and air flow to vaporize the LNG flowing through the heat exchange tubes 12. As will be discussed in further detail below, keeping the heated air below the natural gas auto ignition temperature is intended to prevent or mitigate against auto ignition of any natural gas inside the heat exchanger section 14.

While the cooling air assembly 38 in this embodiment is designed to inject air into the inner barrel assembly 28, the cooling air assembly can be readily adapted by one skilled in the art for vaporizer apparatuses having a different burner design, such as those produced by Cryoquip.

In this embodiment, the cooling air assembly 38 provides air flow into the inner barrel assembly 28 at a rate that is a fixed ratio of the air flow rate produced by the primary blower 22. In one alternative embodiment, controllable air flow valves (not shown) can be provided at one or more of the openings of the cooling air assembly 38 to dynamically alter the ratio of air flow entering the inner barrel assembly 28 via the central air inlet and the cooling air assembly 38.

In another alternative embodiment, the cooling air assembly 38 can further comprise a secondary cooling air source 40 (shown schematically in FIG. 2) to allow fully independent control of air flow into the inner barrel assembly 28. This permits control of the temperature of the heated air flowing into the heat exchanger section 14 independent of the primary blower 22. The secondary cooling air source 40 comprises a pressured air source ("blower") such as a fan or a compressor (not shown) and a cooling air conduit 41 that directs air from the pressured air source through the burner section enclosure and into the inner barrel assembly 28 at any point where the cooling air will not interfere with the correct supply of combustion air to the burner yet still sufficiently mix with the heated air. Optionally, a mixing device (not shown) to fully mix combustion air with cooling air may be included between the burner and exchanger sections of the vaporizer. The device is to prevent 'hot spots' where the combustion air may channel through the cooling air and impinge upon the exchanger bundles at or near the combustion temperature. The mixing device may be comprised of a simple perforated mixing plate, a flow splitter, a spiral mixer, a turbulizer, or a rotating fin mixer.

The cooling air can be provided at just slightly above the internal operating pressure of the vaporizer apparatus 2, e.g., near atmospheric pressure. Relatively cool ambient air is a suitable source for the cooling air to provide the desired temperature control. Further, any ambient or further cooled air or non-combustible gas may be deployed as is sufficient to achieve the target heated air temperature. The volumetric rate of the secondary cooling air will be dependent upon the specific vaporizer apparatus configuration, burner fuel rate, rate of combustion air, primary cooling air rate and the resulting heat air temperature impinging on the LNG conduit bundles 12. For a vaporizer configuration where the temperature of the heated air at the heat exchange tubes 12 is near the flame temperature, the secondary cooling air rate may need to equal or greater than that of the supply air flow rate. Where the temperature of the heated air at the LNG conduit bundles 12 is lower and near the target temperature (i.e., below auto-ignition of the vaporous natural gas) only a small proportion of the supply air flow may need to be added with cooling air from the secondary cooling air assembly 38.

Figure 6:
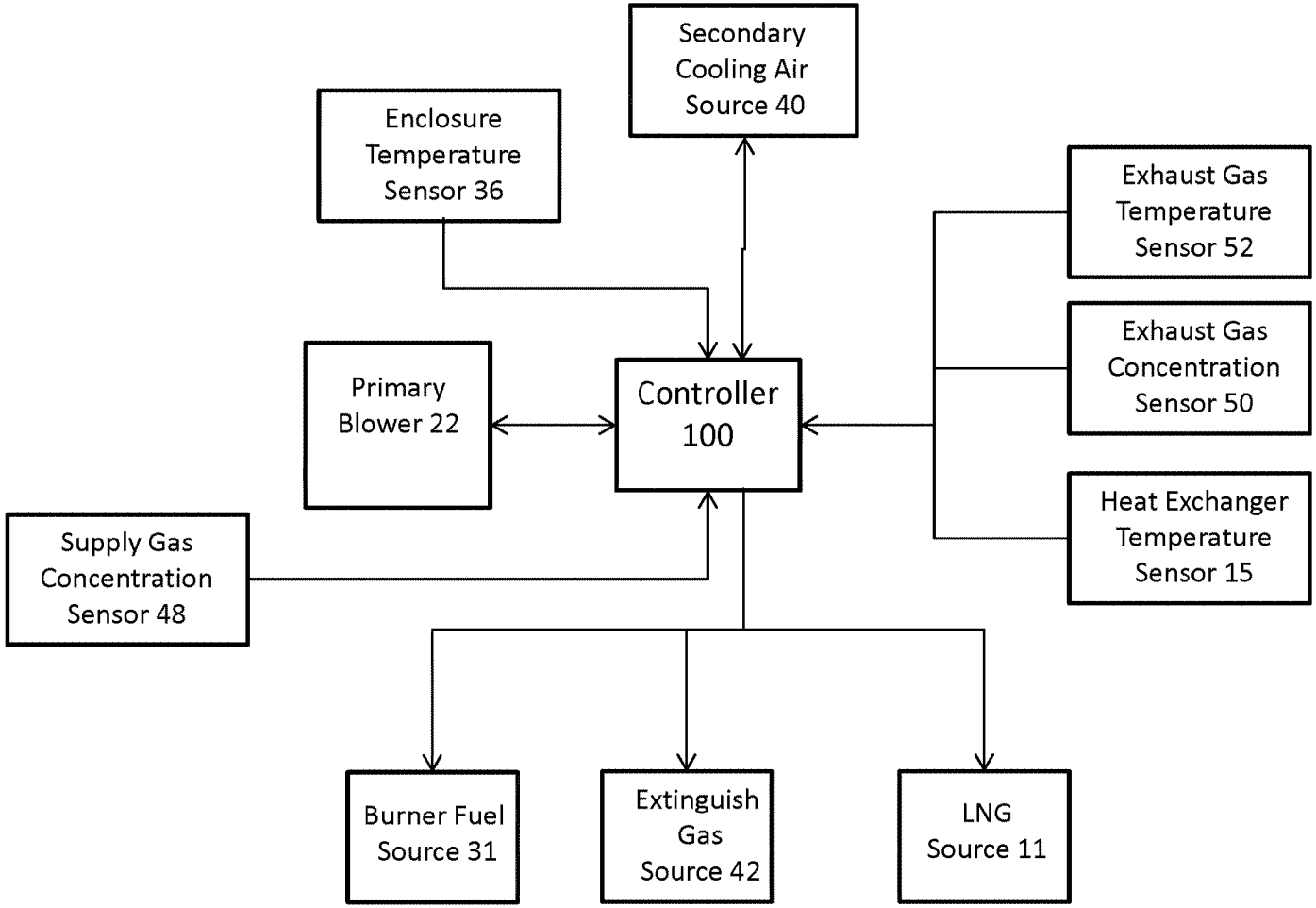
FIG. 6 is a schematic block diagram of a control system of the LNG vaporizer that includes a controller encoded with executable program code for carrying out the methods for starting, operating and shutting down the LNG vaporizer.

The burner section 16 further comprises an extinguish gas injection assembly 42 that is operable to inject an extinguishing gas into the inner barrel assembly 28 in a normal or emergency shutdown operation, to extinguish the flame therein and in the entire vaporizer apparatus enclosure. The extinguishing gas can be an inert gas that serves to displace oxygen and flammable vapors inside the vaporizer apparatus 2, thereby extinguishing any combustion therein; this process will eliminate an internal fire supported by flammable vapors ingested from the external atmosphere or that is sourced through a leak from the heat exchange tubes 12. The extinguish gas injection assembly 42 comprises a plurality of inert gas conduits coupled to an extinguishing gas source such as nitrogen (not shown) or another commonly used extinguishing gas. Some of the conduits extend through openings in the burner assembly mounting plate and another conduit extends through the central air inlet in the mounting plate. In the case of a pressurized extinguishing gas source, such as nitrogen, a pressure regulator (not shown) can be positioned at the outlet of a nitrogen pressure tank to drop the pressure to near atmospheric pressure, followed by a valve 43 to release the extinguishing gas into the burner section 16 upon demand. The valve 43 can be controlled and operated during a vaporizer shutdown operation by a controller 100 (see FIG. 6). As the vaporizer apparatus 2 is not internally pressurized, a release of extinguishing gas sufficient to purge the entire enclosed volume inside the vaporizer apparatus 2 at least two times may be sufficient to ensure a rogue flame is extinguished or all oxygen therein is purged to below the flammable limit.

The primary blower assembly 20 comprises the primary blower 22 oriented to move air into the burner section 16, a flame arrestor 44 mounted to an upstream end of the primary blower 22 and in air flow communication with an inlet end of the primary blower 22, a mag pickup 49 which is coupled by a communications cable (not shown) to the controller 100 that is programmed to control the operation of the primary blower 22, and a supply gas concentration sensor 48 configured to detect the concentration of natural gas in air immediately outside of the primary blower assembly 20. Suitable gas concentration sensors are known in the art, and can include a gas detector such as the Honeywell Zareba Sensepoint Gas Detector Transmitter for Methane.

The primary blower 22 can be based on blowers used in commercially available nitrogen vaporizers, such as those supplied by NOV Hydra Rig. Alternatively, the primary blower can be a fan, compressor or any other means of moving air sufficiently to provide the required air flow volume for vaporizing LNG in the conduit 12.

The flame arrestor 44 (also known as a flashback preventer) is configured to isolate the inlet air feed from the burner section 16. The flame arrestor 44 comprises an apertured element and a housing which mounts to the upstream end of the primary blower 22. Alternatively, the flame arrestor 44 can be mounted internally to the vaporizer apparatus 2 enclosure as appropriate to the specific configuration of the vaporizer apparatus 2. The apertured element prevents a flame from propagating through a flammable atmosphere past the apertured element. Typically, the apertured element is comprised of a number of narrow passages or channels, which can be constructed of metal or other heat-conductive material, that serve to remove heat from the flame as it attempts to travel through the flame arrestor 44. Removal of heat should extinguish the flame and stop propagation of the flame within the flame arrestor 44. Different flammable gases, due to burning velocity and heat content, have different arrestor channel apertures to contain the flame. Methane, for example, has a determined diameter of 3.2 mm, compared to butane at 2.8 mm and pentane at 4.18 mm. The selected passage aperture for the flame arrestor 44 is typically 50% of the determined diameter with a common single channel aperture of 1.4 mm. As an alternative to the flame arrestor 44 design described in this embodiment, any static device that prevents a flame within the burner or vaporizer enclosure from propagating through the inlet to a potentially flammable outside atmosphere may be used as the flamer arrestor. For example, selectively sized beads of any non-flammable, heat absorbing composition may be packed into a container and used as the flame arrestor. Also, the flame arrestor(s) may be placed in a different location than that of this embodiment and for example, can be placed in another location in the vaporizer apparatus between the burner and the external atmosphere.

The exhaust ducting 18 has an air inlet which mates with the air outlet of the heat exchanger section 14 and an air outlet which extends upwards and away from the vaporizer apparatus 2. An exhaust gas concentration sensor 50 and an exhaust gas temperature probe 52 are mounted at the outlet end of the exhaust ducting 18. Optionally, an ultraviolet (UV) or infrared (IR) based flame detector (not shown) such as the Emerson Process Management UV/IRS Flame Detector™ may be mounted at the outlet end of the exhaust ducting to monitor for presence a flame.

Referring now to FIGS. 3 to 6, the controller 100 is communicative with the gas concentration and temperature sensors 15, 36, 48, 50, 52 in the vaporizer apparatus 2 to receive respective gas concentration and temperature data, as well as with the primary blower 22 to control the flow of supply air, the burner fuel source 31 to control the flow of burner fuel, the extinguish gas source 42 to control the flow of extinguishing gas, and when installed, the secondary cooling air source 40 to control the flow of secondary cooling air. The controller 100 can directly control the LNG source 4 to control the flow of LNG through the conduit 12, or indirectly control the flow of LNG via an LNG control system (not shown).

The controller 100 can be a general purpose computer, or a standalone controller such as a programmable logic controller (PLC). For example, a suitable controller can be a model ESX-3XL controller provided by STW (Sensor-Technik Wiedemann). The controller 100 comprises a processor and a non-transitory memory; the memory has encoded thereon program code executable by the processor to perform a start-up procedure as shown in FIG. 3, an operating procedure as shown in FIG. 4, and a shut-down procedure as shown in FIG. 5.

Figure 3:
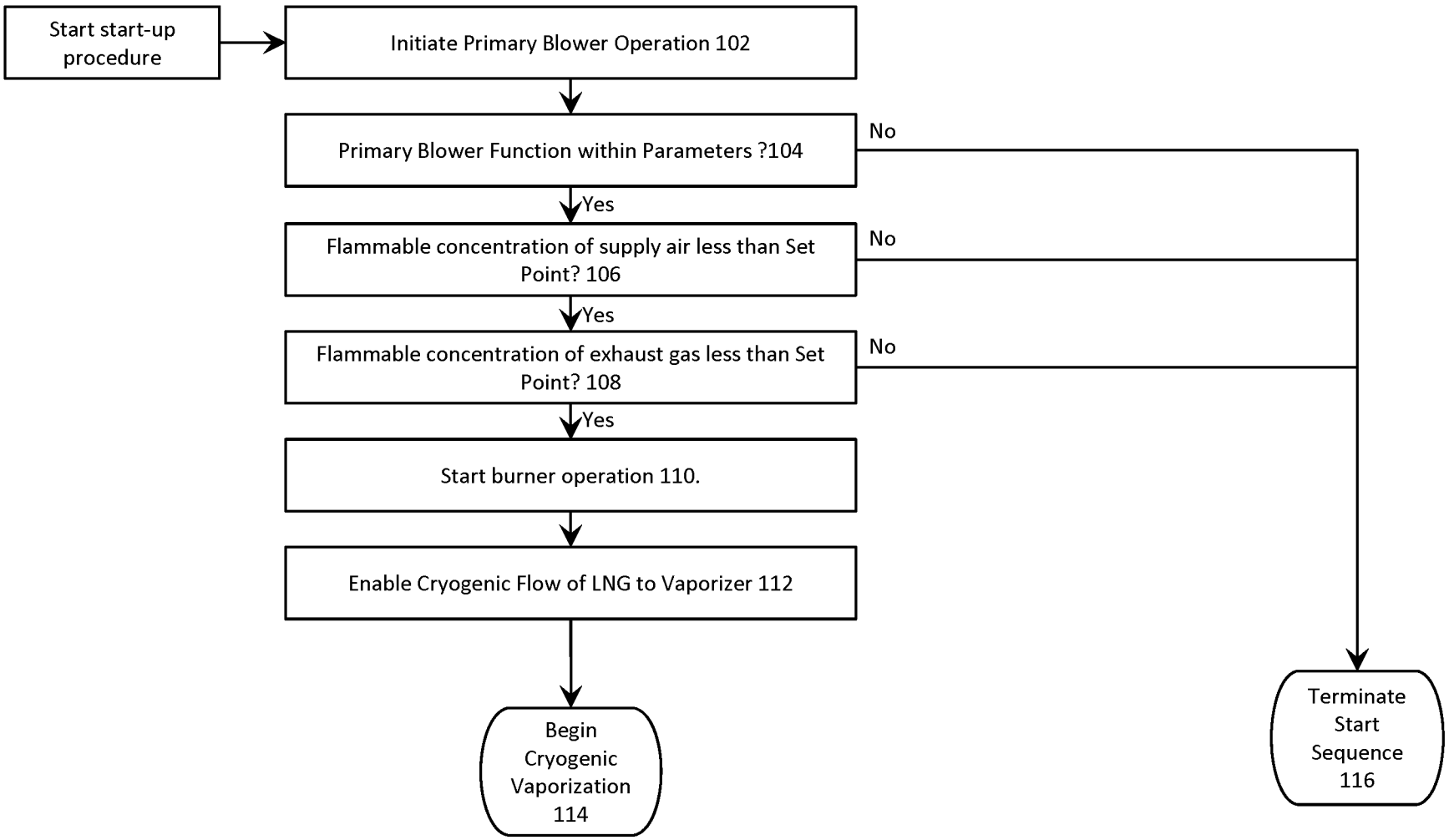
FIG. 3 is a flowchart of a method for starting the LNG vaporizer.

Referring particularly to FIG. 3, the start-up procedure comprises first initiating a primary blower operation (step 102). In this operation, the controller 100 checks whether the primary blower 22 is functioning within manufacturer defined parameters (step 104), and if yes, then the controller 100 reads the supply gas concentration sensor 48 and determines whether the measured concentration of methane in the air outside the supply air inlet duct 17 is below a defined flammable gas concentration set point which is typically 5% to 75% of the lower flammable limit (LFL) of the flammable gas; for example the LFL for methane is 5 vol % (step 106). This measurement determines whether any flammable gas exists in the supply air which may indicate an upcoming flammable gas concentration above the LFL and subsequently pose a risk of an uncontrolled combustion event inside the vaporizer apparatus 2; an excessive concentration of flammable gas in the supply air can be caused by the presence of natural gas in the vicinity of the vaporizer apparatus 2 leaked from the well, from another natural gas source or from accompanying LNG storage and fracturing equipment. If yes, then the controller 100 reads the exhaust gas concentration sensor 50 and determines whether the measured concentration of methane in the heat exchanger section 14 and exhaust ducting 18 are below a defined flammable gas concentration set point, which can be the same set point as the flammable gas concentration set point of the supply gas concentration sensor 48 (step 108). This measurement determines whether a concentration of flammable gas exists in the exhaust section of the vaporizer apparatus 2 and indicates a leak of LNG or LNG vapor from the bundles 12. A bundle 12 leak may indicate impending bundle failure with the risk and hazard of flammable gas released into the operating area. Further, upon shutdown, a bundle 12 leak may result in flammable gas released within the vaporizer enclosure and possible migration of the gas to the hot burner assembly and subsequent ignition. Incomplete combustion of fuel within the vaporizer indicates a potential hazard with incomplete vaporization of the LNG and possible cryogenic damage to downstream components or potentially uncontrolled ignition of accumulated fuel within the vaporizer apparatus and potential damage.

If the measured concentrations of flammable gas in the supply air and exhaust gases are below their respective flammable gas concentration set points, and the primary blower 22 is operating properly, then the controller 100 starts the burner operation (step 112) and causes LNG to flow through the LNG conduit 12 into the vaporizer apparatus 2 (step 114). If any of these conditions are not met, then the controller 100 terminates the start-up sequence (step 116). The burner operation comprises having the controller 100 start operation of the primary blower 22, open a fuel valve of the burner fuel source 31 to cause burner fuel to flow to the fuel nozzle of the burner assembly 30, and operate the ignition module of the burner assembly 30 to ignite the burner fuel. The specific settings of the primary blower 22, fuel valve and ignition module will depend on the specifications and design of the vaporizer apparatus 2. In this embodiment, the burner operation is configured to combust fuel at a rate that generates enough heat to vaporize the LNG flowing through the heat exchange tubes 12 at a specified LNG flow rate and to heat the vaporized natural gas to a target application temperature. Generally, the minimum temperature required to vaporize LNG at critical pressure is approximately −83° C. In this hydraulic fracturing embodiment, the burner assembly 30 and primary blower 22 are operated to generate enough heat energy and supply a sufficient rate of heated air to vaporize the LNG and raise the temperature of the vapor phase natural gas to an application temperature in the range of 0° C. (32° F.) to 20° C. (68° F.).

Figure 4:
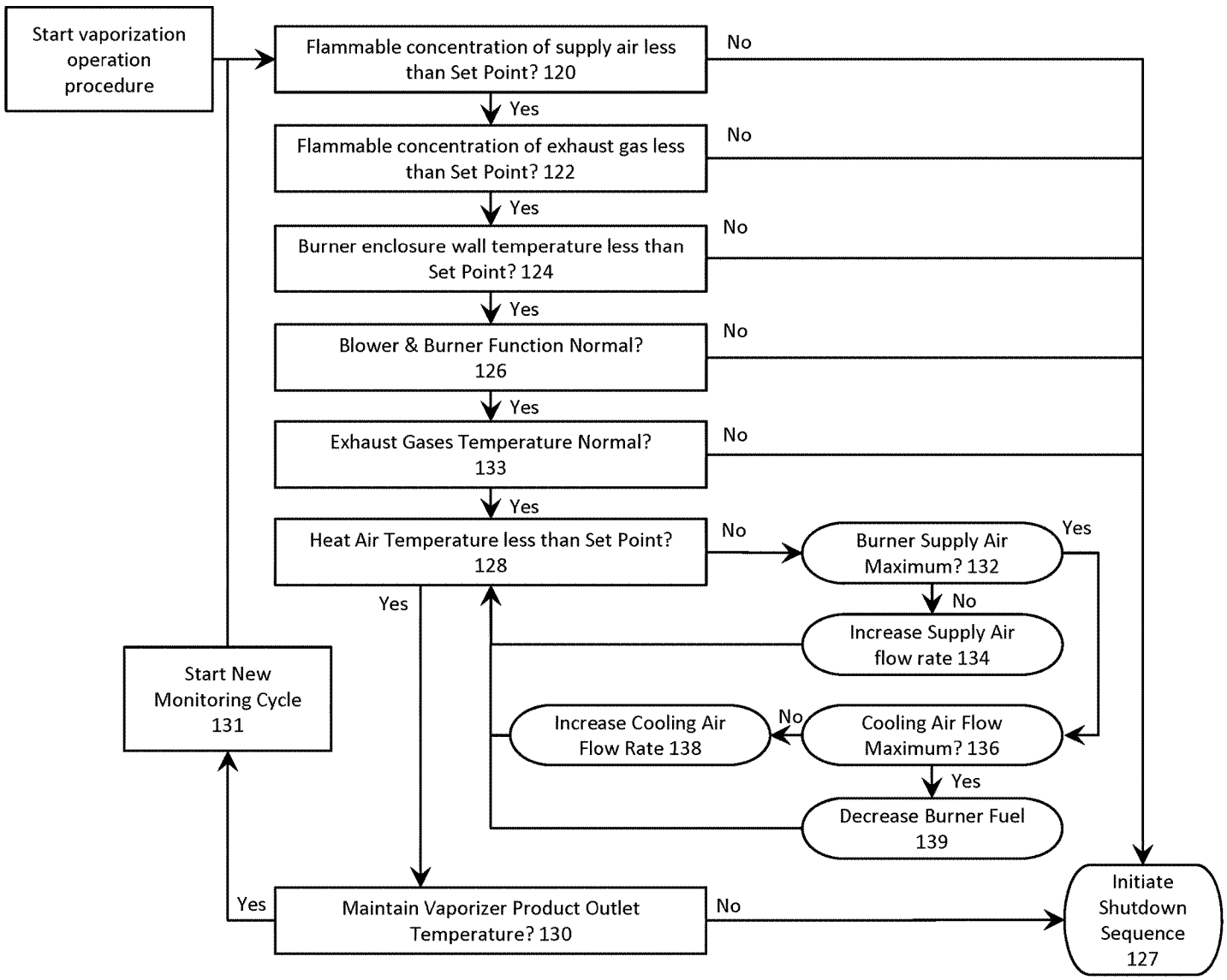
FIG. 4 is a flowchart of a method for operating the LNG vaporizer.
Figure 5:
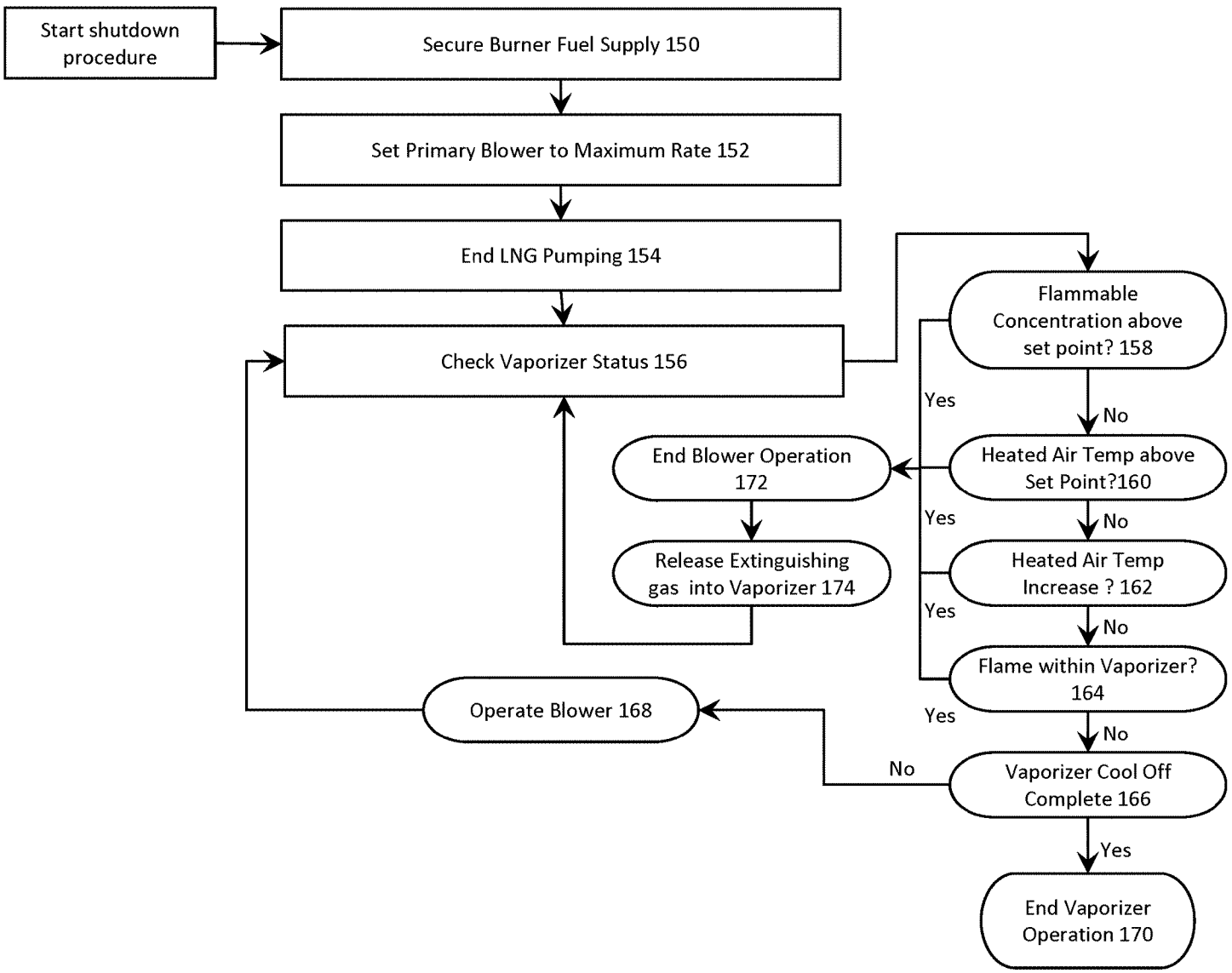
FIG. 5 is a flowchart of a method for shutting down the LNG vaporizer.

Referring particularly to FIG. 4, the operating procedure generally comprises controlling operation of the vaporizer apparatus 2 to ensure that the concentration of flammable gas in the supply air and exhaust gases stay below their respective flammable gas concentration set points, and to ensure that the temperature of the heating air stream contacting the bundles 22 inside the vaporizer apparatus 2 stays below the auto-ignition temperature of natural gas. The controller 100 reads the supply gas concentration sensor 48 and determines whether the measured concentration of methane in the air outside the supply air inlet duct 17 is below the defined flammable gas concentration set point (step 120), reads the exhaust gas concentration sensor 50 and determines whether the measured concentration of flammable gas in the heat exchanger section 14 and exhaust ducting 18 are below a defined flammable gas concentration set point (step 122), reads the enclosure temperature sensor 36 and determines whether the enclosure wall temperature is below a defined temperature set point, which is typically the natural gas auto-ignition temperature plus a safety factor (step 124), and checks whether the primary blower 22 and burner assembly 30 are operating within their manufacturers' defined parameters (step 126), and checks the temperature sensor 52 to determine if the exhaust gas temperature is within a normal range (step 133). By checking the temperature sensor 52 in step 133, it can be determined that there has not been a LNG leak in the bundles 12 with subsequent ignition and a fire burning away unnoticed within the exhaust assembly 18. This is tracked as a relative value where the expected temperature of the exhaust gases is logically at least less than the heat air temperature to the bundles.

If any of these readings are negative, then the controller 100 initiates an emergency shutdown procedure (step 127). If all of these readings are positive, then the controller 100 reads the heat exchanger temperature sensor 15 to determine if the temperature of the heated air in the burner assembly 16 is below a defined temperature set point (step 128), which typically is the auto-ignition temperature of natural gas plus a safety factor. This calculation assumes the air temperature measured by the temperature sensor 15 is the same as the air temperature at the heat exchange tubes 12; however, adjustments to the calculation can be made when this is not the case (e.g. if the temperature sensor 15 is located at a different location in the heat exchanger section according to alternative embodiments). If the determination is positive, then the vaporizer apparatus 2 is operating within its operational limits, and the controller 100 is free to control the primary blower 22 and burner assembly 30 to generate sufficient heat energy and air flow to vaporize the LNG to the desired application temperature (step 130) and then returns to the start point (step 131) to repeat the monitoring steps 120-128.

If the determination is negative, then the heated air temperature is too high. Before the controller 100 initiates an emergency shutdown procedure, it first tries to lower the heated air temperature by (1) flowing more supply air to the burner assembly 30, and/or (2) flowing more cooling air into the inner barrel assembly 28. In the first attempt, the controller 100 checks whether the primary blower 22 is operating at its maximum blower setting (step 132); if no, then the controller 100 instructs the primary blower 22 to increase the air flow rate by a defined increment (step 134) and the controller 100 returns to step 128 to check whether the heated air temperature has dropped to below the defined temperature set point.

If the primary blower 22 is operating at its maximum blower setting, then the controller 100 proceeds to check whether the cooling air flow can be increased. In the optional embodiment comprising controllable cooling air flow valves, the controller 100 determines whether the air flow valves are already fully opened. In the optional embodiment comprising a secondary cooling air source 40, the controller 100 determines whether the cooling air blower or other cooling air source is operating at its maximum setting (step 136). If the determination is positive, then the controller 100 proceeds to decrease the fuel flow to the burner section (step 139) to reduce heat produced by the burner and thus reduce the heat air temperature and returns to step 128 to check whether the heated air temperature has dropped below the defined temperature set point. If the determination of step 136 is negative, then the controller 100 increases the cooling air flow rate (step 138), either by opening the valves by a defined increment or increasing the cooling air blower setting by a defined increment. The controller 100 then returns to step 128 to check whether the heated air temperature has dropped to below the defined temperature set point. If negative, the controller 100 initiates the shutdown procedure (step 127).

Referring now to FIG. 5, the controller 100 initiates the shutdown procedure when an emergency shutdown is required, or when the vaporizer of the LNG is no longer required (normal shutdown). The controller 100 first secures the burner fuel supply (step 150) by shutting off the fuel valve 32 of the burner fuel source 31. Then the controller 100 sets the primary blower 22 to it maximum blower setting (step 152) to try to purge any flammable gases from the vaporizer apparatus 2. Then, the controller 100 ends the LNG pumping by closing the LNG supply valve and stopping the LNG pump, or instructing the LNG control system to do so (step 154). Then, the controller 100 performs a vaporizer apparatus status check (step 156) by reading the supply gas concentration sensor 48 and the exhaust gas concentration sensor 50 and determining if the concentration of flammable gas in the supply air and exhaust gases are below their respective flammable gas concentration set points (step 158), reading the heat exchanger and exhaust gas temperature sensors 15, 52 to determine if the heated air and exhaust gases are below their respective temperature set points (step 160), or have increased since the last measurement (step 162), and reading the fire burner photocell unit 33 to determine if there is still a flame in the vaporizer apparatus 2 (step 164).

If the status check determinations are all negative, then the controller 100 starts a cool-off sequence; typically prescribed by the manufacturer to a target cool-off temperature generally between 150 F (65° C.) to 400 F (200° C.) (step 166), ensures that the primary blower 22 is operating (step 168) (and if the primary blower 22 is not operating, to turn it on) and returns to step 156 to repeat the status check. This loop is repeated until the sequence is finished, in which case the controller 100 ends the shutdown procedure (step 170).

If any of the status check determinations are positive, then the controller 100 shuts off the primary blower (step 172), and releases the extinguishing gas into the inner barrel assembly 28 by opening the extinguish gas source valve 43. The controller 100 then closes the extinguish gas source valve 43 and returns to step 156 to repeat the vaporizer status check, and if any of the status checks 158-164 are positive, then the controller 100 releases more extinguishing gas into the burner assembly 28. This loop is repeated until all of the status checks 158-166 return positive and the cool-off sequence is complete, in which case the controller ends the vaporizer operation.

While particular embodiments have been described in this description, it is to be understood that other embodiments are possible and that the invention is not limited to the described embodiments and instead are defined by the claims. For example, in an alternative embodiment, there are no temperature sensors in the heat exchanger section and the operating procedure comprises controlling operation of the vaporizer apparatus 2 to ensure that only the flammable gas concentration in the supply air is kept below the flammable gas concentration set point. In another alternative embodiment, the operating procedure control vaporizer apparatus 2 operation to ensure that the flammable concentration in both the supply air and exhaust gases are below their respective flammable gas concentration set points.

What is claimed is:

1. A system for injecting vapor-phase natural gas into an oil or gas well, comprising:

(a) a pump configured to pressurize liquefied natural gas (LNG) to fracturing pressure; and (b) a vaporizer apparatus for vaporizing LNG into the vapor-phase natural gas, the vaporizer apparatus fluidly coupled to the pump and comprising:

(i) a blower assembly comprising a primary blower configured to move air along a supply air flow path through the vaporizer apparatus;

(ii) a burner section comprising an enclosure having an upstream end coupled to the blower assembly and a downstream end, and at least one burner inside the enclosure and in the supply air flow path for heating the air;

(iii) a heat exchanger section comprising an enclosure having an upstream end coupled to the downstream end of the burner section enclosure and a downstream end, and at least one LNG heat exchange tube inside A the enclosure and in the supply air flow path, and thermally communicable with the air heated by the burner; and (iv) at least one flammable gas concentration sensor in the air flow path upstream of the burner and configured to detect whether a concentration of a flammable gas in the air is above a flammable gas concentration set point.

2. A vaporizer apparatus as claimed in claim 1 wherein the blower assembly further comprises a flame arrestor configured to allow passage of the air into the vaporizer apparatus and impede passage of a flame out of the vaporizer apparatus.

3. A vaporizer apparatus as claimed in claim 1 wherein the at least one flammable gas concentration sensor comprises a gas concentration sensor mounted outside the vaporizer apparatus and in the supply air flow path upstream of the primary blower.

4. A vaporizer apparatus as claimed in claim 3 further comprising an exhaust duct having an upstream end coupled to the downstream end of the heat exchanger enclosure, and an outlet for discharging the air and combustion products from the vaporizer apparatus; and at least one ultraviolet or infrared flame detector in the exhaust duct.

5. A vaporizer apparatus as claimed in claim 1 further comprising at least one temperature sensor inside the vaporizer apparatus downstream of the burner, and configured to detect whether the temperature inside the vaporizer apparatus is above a temperature set point.

6. A vaporizer apparatus as claimed in claim 5 further comprising an exhaust duct having an upstream end coupled to the downstream end of the heat exchanger enclosure, an outlet for discharging the air and combustion products from the vaporizer apparatus, and wherein the at least one temperature sensor comprises an exhaust temperature sensor in the exhaust duct.

7. A vaporizer apparatus as claimed in claim 5 wherein the at least one temperature sensor comprises a heat exchanger temperature sensor inside the heat exchanger enclosure and configured to measure the temperature of the air blown by the primary blower and heated by the burner.

8. A vaporizer apparatus as claimed in claim 1 further comprising an exhaust duct having an upstream end coupled to the downstream end of the heat exchanger enclosure, an outlet for discharging the air and combustion products from the vaporizer apparatus, and wherein the at least one flammable gas concentration sensor comprises an exhaust gas concentration sensor in the exhaust duct.

9. A vaporizer apparatus as claimed in claim 1 wherein the blower assembly, burner section enclosure, and heat exchanger section enclosure are sealed or gasketed to produce at least a flame-tight air flow pathway through the inside of the vaporizer apparatus.

10. A vaporizer apparatus as claimed in claim 1 further comprising a cooling air assembly comprising a secondary cooling air source in air flow communication with the air moved by the primary blower and heated by the burner.

11. A vaporizer apparatus as claimed in claim 10 wherein the secondary cooling air source comprises a cooling air blower controllable independently from the primary blower.

12. A vaporizer apparatus as claimed in claim 1 further comprising a cooling air assembly comprising at least one cooling air duct having an inlet in air flow communication with the air moved by the primary blower but not heated by the burner, and an outlet in air flow communication with the air moved by the primary blower and heated by the burner, and a control valve in air flow communication with the at least one cooling air duct and operable to control the flow rate of air flowing therethrough.

13. A method for injecting vapor-phase natural gas into an oil or gas well, comprising:

(a) operating a primary blower to move air into the vaporizer apparatus;

(b) measuring a flammable gas concentration in the air;

(c) only when the measured flammable gas concentration is below a flammable gas concentration set point, operating a burner to provide the air with enough heat energy to vaporize LNG flowing through at least one heat exchange tube inside the vaporizer apparatus;

(d) operating a pump to pressurize the LNG to fracturing pressure; and (e) injecting the vapor-phase natural gas into the oil or gas well.

14. A method as claimed in claim 13 further comprising: measuring a temperature of the air moved into the vaporizer apparatus and heated by the burner, and only when the measured temperature of the air is below a temperature set point, operating the burner to provide the air with enough heat energy to vaporize LNG flowing through at least one heat exchange tube inside the vaporizer apparatus.

15. A method as claimed in claim 14 further comprising: when the measured temperature of the heated air is at or above the temperature set point, adjusting the primary blower operation to increase the flow rate of the air through the vaporizer apparatus.

16. A method as claimed in claim 15 further comprising: when the measured temperature of the air is at or above the temperature set point, moving cooling air into the vaporizer apparatus to cool the air moved by the primary blower and heated by the burner.

17. A method as claimed in claim 14 further comprising: when the measured temperature of the air is at or above the temperature set point, decreasing a supply of burner fuel to the burner to reduce heating of the air by the burner.

18. A method as claimed in claim 14 further comprising at least one of: measuring a flammable gas concentration in exhaust air heated by the burner, and monitoring for a flame in the vaporizer apparatus downstream of the burner, and when the measured flammable gas concentration in the exhaust air is at or above the flammable gas concentration set point or when a flame is detected, stopping operation of the primary blower and burner.

19. A method as claimed in claim 18 wherein stopping operation of the primary blower and burner further comprises measuring the flammable gas concentration and air temperature inside the vaporizer and releasing an extinguishing gas into the vaporizer apparatus when at least one of the measured flammable gas concentration and air temperature is at or above the respective flammable gas concentration set point and temperature set point.

20. A method as claimed in claim 13 further comprising: when the measured flammable gas concentration is at or above the flammable gas concentration set point, stopping operation of the primary blower and burner.

21. A method as claimed in claim 20 wherein stopping operation of the primary blower and burner further comprises purging the vaporizer apparatus by operating the primary blower to move air through the vaporizer apparatus.

* * * * *